US009449497B2

(12) United States Patent
Hyun et al.

(10) Patent No.: US 9,449,497 B2
(45) Date of Patent: Sep. 20, 2016

(54) METHOD AND SYSTEM FOR DETECTING ALARM SYSTEM TAMPERING

(71) Applicant: Numerex Corp., Atlanta, GA (US)

(72) Inventors: Eugene Hyun, Atlanta, GA (US); Jeffery Smith, Dallas, TX (US); Kevin Brown, Dallas, TX (US); Andrew Wolverton, Dallas, TX (US)

(73) Assignee: Numerex Corp., Atlanta, GA (US)

( * ) Notice: Subject to any disclaimer, the term of this patent is extended or adjusted under 35 U.S.C. 154(b) by 208 days.

(21) Appl. No.: 14/522,965

(22) Filed: Oct. 24, 2014

(65) Prior Publication Data

US 2016/0117916 A1 Apr. 28, 2016

(51) Int. Cl.
*G08B 29/12* (2006.01)
*G08B 25/00* (2006.01)

(52) U.S. Cl.
CPC ..... *G08B 29/12* (2013.01); *G08B 25/007* (2013.01)

(58) Field of Classification Search
CPC .... G08B 29/02; G08B 29/04; G08B 29/046; G08B 29/06; G08B 29/08; G08B 29/12; G08B 25/00; G08B 25/001; G08B 25/007; G08B 25/008
See application file for complete search history.

(56) References Cited

U.S. PATENT DOCUMENTS 4,032,916 A * 6/1977 Galvin ..... G08B 29/06 340/508
4,465,904 A 8/1984 Gottsegen et al.
4,692,742 A 9/1987 Raizen et al.
4,918,717 A 4/1990 Bissonnette et al.
5,134,644 A 7/1992 Garton et al.
5,195,126 A 3/1993 Carrier et al.
5,365,568 A 11/1994 Gilbert
5,400,011 A 3/1995 Sutton
5,463,595 A 10/1995 Rodhall
5,568,475 A 10/1996 Doshi et al.
5,736,927 A 4/1998 Stebbins et al.
5,796,633 A 8/1998 Burgess et al.
5,808,547 A 9/1998 Carney
5,838,223 A 11/1998 Gallant et al.
5,877,684 A 3/1999 Lu
5,923,731 A 7/1999 McClure
5,940,474 A 8/1999 Ruus
6,075,451 A 6/2000 Lebowitz et al.
6,215,404 B1 4/2001 Morales
6,243,373 B1 6/2001 Turock
6,272,212 B1 8/2001 Wulforst et al.
6,288,642 B1 9/2001 Dohrmann
6,311,072 B1 10/2001 Barclay et al.
6,369,705 B1 4/2002 Kennedy (Continued)

*Primary Examiner* — James Yang
*Assistant Examiner* — Laura Nguyen
(74) *Attorney, Agent, or Firm* — King & Spalding LLP

(57) ABSTRACT

An alarm system monitors a home, business, or other property for fire, burglary, break-in, or other event that may warrant raising an alarm. The alarm system is configured to detect tampering, whereby someone intentionally impedes the ability of the system to raise an alarm or otherwise interferes the system's operation. An alarm panel of the alarm system communicates with a server. At certain times, the alarm system transmits a series of packets to the server using a unidirectional protocol. Upon receipt of one of the packets, the server alternates between monitoring for an incoming packet and ignoring any incoming packets. Detection of an incoming packet during a monitoring time period causes the server to transition to ignoring packets for a sleep period of time. Completion of the sleep period of time causes the server to return to monitoring for the monitoring period of time.

20 Claims, 3 Drawing Sheets

(56) References Cited

U.S. PATENT DOCUMENTS

| | | | |
|---|---|---|---|
| 6,381,307 | B1 | 4/2002 | Jeffers et al. |
| 6,400,265 | B1 | 6/2002 | Saylor et al. |
| 6,438,124 | B1 | 8/2002 | Wilkes et al. |
| 6,452,490 | B1 | 9/2002 | Garland et al. |
| 6,493,435 | B1 | 12/2002 | Petricoin |
| 6,553,100 | B1 | 4/2003 | Chen et al. |
| 6,574,480 | B1 | 6/2003 | Foladare et al. |
| 6,577,234 | B1 | 6/2003 | Dohrmann |
| 6,603,845 | B2 | 8/2003 | Jensen et al. |
| 6,661,340 | B1 | 12/2003 | Saylor et al. |
| 6,683,526 | B2 | 1/2004 | Bellin |
| 6,829,478 | B1 | 12/2004 | Layton et al. |
| 6,831,557 | B1 | 12/2004 | Hess |
| 6,870,906 | B2 | 3/2005 | Dawson |
| 6,928,148 | B2 | 8/2005 | Simon et al. |
| 6,965,313 | B1 | 11/2005 | Saylor et al. |
| 6,973,165 | B2 | 12/2005 | Giacopelli et al. |
| 7,002,462 | B2 | 2/2006 | Welch |
| 7,009,519 | B2 | 3/2006 | Leonard et al. |
| 7,103,152 | B2 | 9/2006 | Naidoo et al. |
| 7,113,090 | B1 | 9/2006 | Saylor et al. |
| 7,119,609 | B2 | 10/2006 | Naidoo et al. |
| 7,245,703 | B2 | 7/2007 | Elliot et al. |
| 7,262,690 | B2 | 8/2007 | Heaton et al. |
| 7,406,710 | B1 | 7/2008 | Zellner et al. |
| 7,429,921 | B2 | 9/2008 | Seeley et al. |
| 7,440,554 | B2 | 10/2008 | Elliot et al. |
| 7,542,721 | B1 | 6/2009 | Bonner et al. |
| 7,558,379 | B2 | 7/2009 | Winick |
| 7,593,512 | B2 | 9/2009 | Elliot et al. |
| 7,593,513 | B2 | 9/2009 | Muller |
| 7,613,278 | B2 | 11/2009 | Elliot et al. |
| 7,619,512 | B2 | 11/2009 | Trundle et al. |
| 7,633,385 | B2 | 12/2009 | Cohn et al. |
| 7,653,186 | B2 | 1/2010 | Hosain et al. |
| 7,734,020 | B2 | 6/2010 | Elliot et al. |
| 7,751,540 | B2 | 7/2010 | Whitfield et al. |
| 7,778,394 | B2 | 8/2010 | Small et al. |
| 7,820,841 | B2 | 10/2010 | Van Toor et al. |
| 7,848,505 | B2 | 12/2010 | Martin et al. |
| 7,853,200 | B2 | 12/2010 | Blum et al. |
| 7,855,635 | B2 | 12/2010 | Cohn et al. |
| 7,911,341 | B2 | 3/2011 | Raji et al. |
| 7,920,841 | B2 | 4/2011 | Martin et al. |
| 7,920,842 | B2 | 4/2011 | Martin et al. |
| 7,920,843 | B2 | 4/2011 | Martin et al. |
| 7,961,088 | B2 | 6/2011 | Watts et al. |
| 8,022,807 | B2 | 9/2011 | Martin et al. |
| 8,073,931 | B2 | 12/2011 | Dawes et al. |
| 8,116,724 | B2 | 2/2012 | Peabody |
| 8,214,494 | B1 | 7/2012 | Slavin |
| 8,335,842 | B2 | 12/2012 | Raji et al. |
| 8,350,694 | B1 | 1/2013 | Trundle et al. |
| 8,395,494 | B2 | 3/2013 | Trundle et al. |
| 8,456,293 | B1 | 6/2013 | Trundle et al. |
| 8,473,619 | B2 | 6/2013 | Baum et al. |
| 8,478,844 | B2 | 7/2013 | Baum et al. |
| 8,493,202 | B1 | 7/2013 | Trundle et al. |
| 8,520,072 | B1 | 8/2013 | Slavin et al. |
| 8,525,665 | B1 | 9/2013 | Trundle et al. |
| 8,626,151 | B2 | 1/2014 | Beppler et al. |
| 2002/0103898 | A1 | 8/2002 | Moyer |
| 2002/0147982 | A1 | 10/2002 | Naidoo et al. |
| 2002/0176581 | A1 | 11/2002 | Bilgic |
| 2002/0177428 | A1 | 11/2002 | Menard et al. |
| 2003/0027547 | A1 | 2/2003 | Wade |
| 2003/0071724 | A1 | 4/2003 | D'Amico |
| 2003/0128115 | A1 | 7/2003 | Giacopelli et al. |
| 2004/0005044 | A1 | 1/2004 | Yeh |
| 2004/0086088 | A1 | 5/2004 | Naidoo |
| 2004/0086093 | A1 | 5/2004 | Schranz |
| 2005/0099893 | A1 | 5/2005 | Jyrinki |
| 2006/0023848 | A1 | 2/2006 | Mohler et al. |
| 2006/0103520 | A1* | 5/2006 | Clark ..... G08B 25/08 340/506 |
| 2006/0176167 | A1 | 8/2006 | Dohrmann |
| 2006/0239250 | A1 | 10/2006 | Elliot et al. |
| 2007/0115930 | A1 | 5/2007 | Reynolds et al. |
| 2007/0155412 | A1 | 7/2007 | Kalsukis |
| 2008/0084291 | A1 | 4/2008 | Campion, Jr. |
| 2008/0117029 | A1 | 5/2008 | Dohrmann et al. |
| 2008/0191863 | A1 | 8/2008 | Boling |
| 2009/0017757 | A1 | 1/2009 | Koga |
| 2009/0077622 | A1 | 3/2009 | Baum et al. |
| 2009/0213999 | A1 | 8/2009 | Farrand |
| 2009/0248967 | A1 | 10/2009 | Sharma et al. |
| 2009/0264155 | A1 | 10/2009 | Nakayama et al. |
| 2009/0274104 | A1 | 11/2009 | Addy |
| 2010/0007488 | A1 | 1/2010 | Sharma et al. |
| 2010/0052890 | A1 | 3/2010 | Trundle |
| 2010/0121948 | A1 | 5/2010 | Procopio |
| 2010/0277271 | A1 | 11/2010 | Elliot et al. |
| 2010/0289643 | A1 | 11/2010 | Trundle |
| 2010/0289644 | A1 | 11/2010 | Slavin |
| 2011/0065414 | A1 | 3/2011 | Frenette |
| 2011/0169628 | A1 | 7/2011 | Elliot |
| 2012/0027010 | A1 | 2/2012 | Elliot |
| 2012/0139718 | A1 | 6/2012 | Foisy et al. |
| 2012/0250833 | A1 | 10/2012 | Smith et al. |
| 2012/0250834 | A1 | 10/2012 | Smith |
| 2012/0275588 | A1 | 11/2012 | Gregory |
| 2013/0189946 | A1 | 7/2013 | Swanson |
| 2013/0194091 | A1* | 8/2013 | Trundle ..... G08B 25/10 340/506 |
| 2013/0207802 | A1* | 8/2013 | Wu ..... G08B 25/001 340/528 |
| 2013/0215266 | A1 | 8/2013 | Trundle |
| 2013/0234840 | A1 | 9/2013 | Trundle |
| 2013/0321150 | A1* | 12/2013 | Koenig ..... G08B 25/008 340/541 |

* cited by examiner

METHOD AND SYSTEM FOR DETECTING ALARM SYSTEM TAMPERING

TECHNICAL FIELD

The present technology relates generally to alarm systems and more particularly to detecting when someone is tampering with an alarm system.

BACKGROUND

A typical alarm system can monitor a home, business, or other property for fire, burglary, break-in, or other event that may warrant raising an alarm. However, alarm systems can be susceptible to tampering, whereby someone intentionally interferes the ability of the alarm system to raise an alarm or otherwise suppresses the alarm system's defenses. Accordingly, there are needs in the art for technologies that can detect and combat alarm system tampering.

Figure 1:
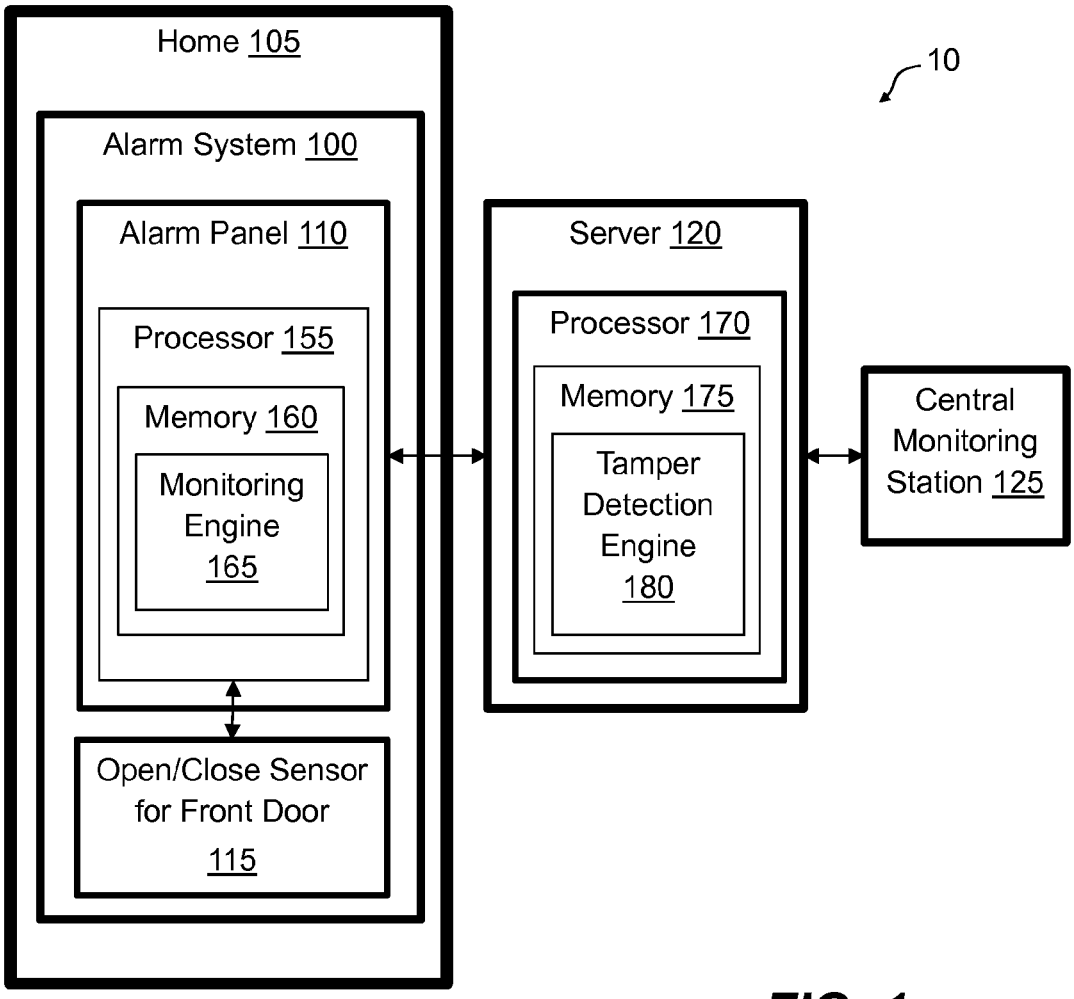
FIG. 1 is functional block diagram of a system for monitoring premises for alarm events according to certain embodiments.

Many aspects of the technology can be better understood with reference to the above drawings. The elements and features shown in the drawings are not necessarily to scale, emphasis being placed upon clearly illustrating the principles of exemplary embodiments of the present technology. Moreover, certain dimensions may be exaggerated to help visually convey such principles.

DETAILED DESCRIPTION

An embodiment of a computer-based system and process for detecting and reporting tampering of an alarm system will be discussed in further detail below with reference to the figures. However, the present technology can be embodied in different forms and should not be construed as limited to the embodiments set forth herein. Rather, these embodiments are provided so that this disclosure will be thorough and complete, and will fully convey the scope of the technology to those having ordinary skill in the art. Furthermore, all "examples," "embodiments," "example embodiments," or "exemplary embodiments" given herein are intended to be non-limiting and among others supported by representations of the present technology.

Certain embodiments comprise or involve processes that will be discussed below. Some process steps may naturally need to precede others to achieve intended functionality or results. However, the technology is not limited to the order of the steps described to the extent that reordering or re-sequencing does not render the processes useless or nonsensical. Thus, it is recognized that some steps may be performed before or after other steps or in parallel with other steps without departing from the scope and spirit of this disclosure.

FIG. 1 illustrates a functional block diagram for a representative operating environment 10 for an alarm system 100. In the operating environment 10, the alarm system 100 monitors a premises, in this case a business or home 105. An alarm panel 110 of the alarm system 100 receives signal inputs from sensors that detect events or conditions that may warrant issuance of an alarm. Such sensors are represented in FIG. 1 by an open/close sensor 115 for a front door.

The alarm panel 110 communicates with a remote, off-premises server 120 that functions as an alarm gateway for multiple other alarm systems at other premises (not illustrated) and provides connectivity to a central monitoring station 125. The central monitoring station 125 monitors the alarm systems and is staffed with people who can dispatch emergency services, such as police and fire responders, on an as-needed basis.

As discussed above, the alarm system 100 includes one or more sensors for detecting various types of alarm events, such as fire, burglary, or medical emergency. Such sensors may include wired and/or wireless magnetic window and door sensors (e.g. the front door sensor 115 illustrated in FIG. 1), glass-break sensors, infra-red sensors, motion sensors, smoke detectors, and carbon monoxide sensors. The sensor suite in any particular installation may be dictated by the alarm supplier and the owner of the home/premises 105 that is monitored by the alarm system 100. The alarm system 100 may further include one or more sirens, speakers, and microphones for sounding an alarm, capturing sounds within the home/premises 105, and amplifying a voice of an agent who is in the central monitor and communicating remotely.

The alarm panel 110 typically includes a display providing a current status of the alarm system 100 and a keypad including buttons and/or other controls to configure and interface with the alarm system 100. A user of the alarm system 100 is able to determine a current status of the alarm system 100 by viewing the display of the alarm panel 110, and may arm and disarm the system through the panel 110. The user may also call for fire, police, and medical emergency personnel using the keypad of the alarm panel 110. The alarm system 100 further includes other wiring and associated circuitry typical of alarm systems.

The alarm panel 110 typically comprises a communication module (not illustrated) for providing a wireless or wired transceiver with circuitry and associated software for establishing data and voice channels. Particularly, the communication module can be configured to establish data and voice channels with the server 120 via a communication path. In operation, the alarm system 100 can detect an alarm event using one or more of the sensors and communicates associated alarm event data to the server 120 using a wired or wireless data channel. The alarm system 100 may also utilize a voice channel between the alarm system 100 and the central alarm monitoring station 125.

The alarm panel 110 comprises a processor 155 that typically includes one or more microprocessors or microcontrollers and associated memory 160. Example embodiments of the memory 160 can comprise volatile and non-volatile memory, such as random access memory (RAM) and flash memory for example. In an example embodiment, the memory 160 can comprise firmware for executing management and control functions. For example, the memory 160 can comprise persistent memory that stores program code, including a monitoring engine 165. An embodiment of the monitoring engine 165 comprises computer executable instructions for making alarm decisions based on input from the front door sensor 115 and other sensors, such as code for the appropriate portions of process 200 and process 260 that are illustrated in flowchart form in FIGS. 2 and 3 and discussed below.

As discussed above, the server 120 provides a gateway between multiple alarm systems 100 and the central monitoring station 125. More specifically, the server 120 provides and facilitates alarm monitoring services for multiple alarm systems at various homes and businesses in addition to the illustrated alarm system 100. The server typically comprises a communication module (not illustrated) that establishes data and voice channels with the alarm panel 110 via a bidirectional communication link that may be wired or wireless. In operation, the server 120 receives alarm event data representative of an alarm event from the alarm system 100 and forwards the alarm event data along with associated information to the central monitoring station 125.

The server 120 comprises a processor 179 that typically includes one or more microprocessors or microcontrollers and associated memory 180. Example embodiments of the memory 175 can comprise volatile and nonvolatile memory, such as random access memory (RAM) and flash memory for example. In an example embodiment, the memory 175 can comprise firmware for executing management and control functions. For example, the memory 175 can comprise persistent memory that stores program code, including a tamper detection engine 180. An embodiment of the tamper detection engine 180 comprises computer executable instructions for identifying and acting on tamper events, such as code for appropriate portions of processes 200 and 260 that are illustrated in flowchart form in FIGS. 2 and 3 and discussed below.

The central monitoring station 125 typically includes at least one agent console and associated communications and computing gear. Personnel, including agents, staff the central monitoring station 125. In a typical operation, each agent is able to view an agent console, which displays information associated with received alarm event data from alarm systems. After receiving alarm event data and associated information from the alarm system 100 and the server 120, the agent console may display details related to an alarm event occurring at the home 105 where the alarm system 100 is installed. For example, based on alarm event data received from the alarm system 100, the agent console may indicate that a fire, panic, burglary, or medical emergency is occurring where the alarm system 100 is installed. Additionally, the agent console may display a street address or geographic coordinates of the home 105 and contact information for fire, police, and medical services. Based on the display, the agent is able to assess the event where the alarm system 100 is installed. Thus, the central monitoring station 125 facilitates monitoring alarm systems installed at multiple locations by agents who assess alarm events, and when deemed appropriate, may contact service personnel based upon alarm event data received from the alarm systems. For example, agents monitoring the alarm system 100 at the central monitoring station 125 may call for fire, police, or medical service personnel to be dispatched to the home 105.

Figure 2:
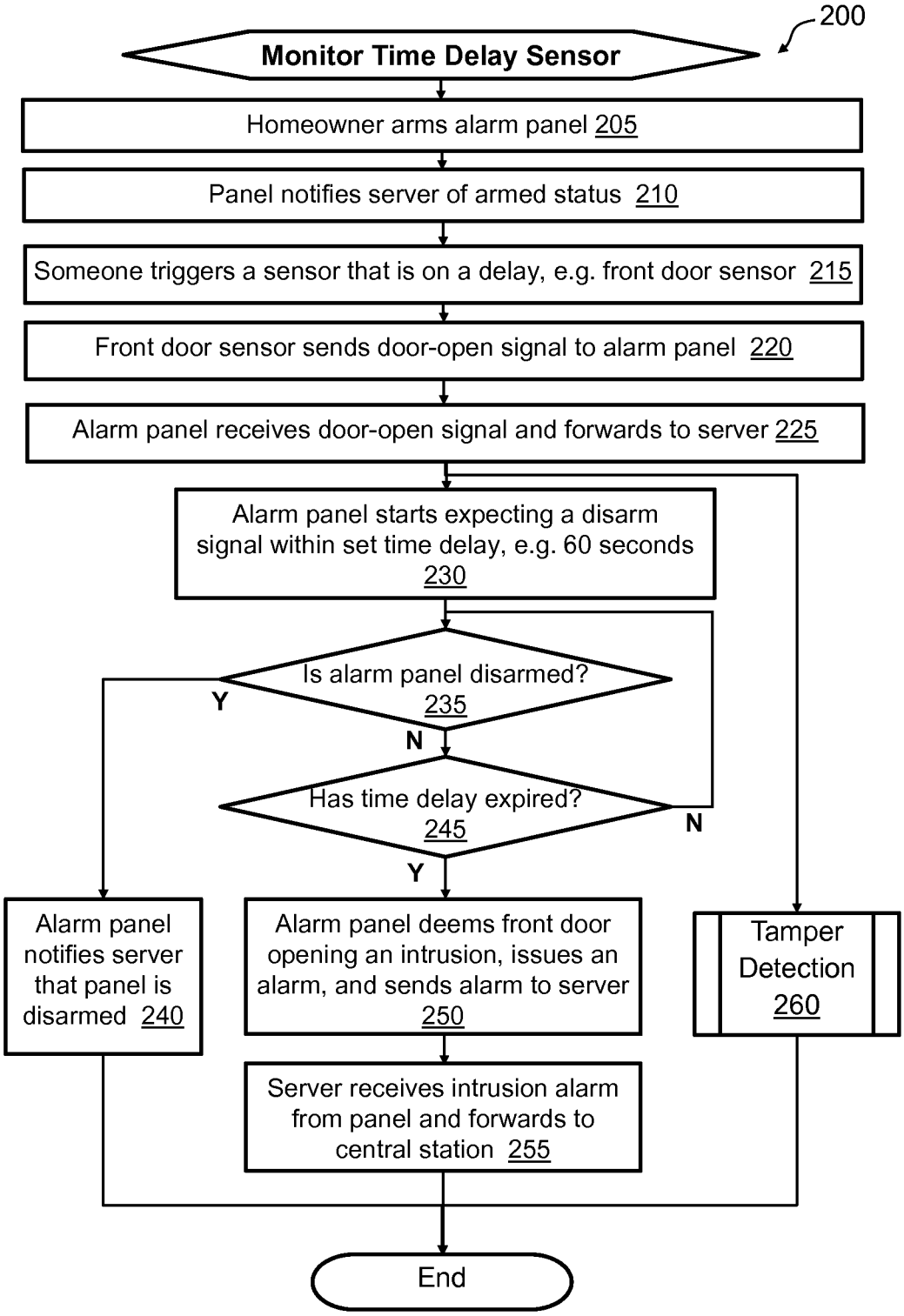
FIG. 2 is a flowchart of a process for alarm monitoring according to certain embodiments.

FIG. 2 illustrates a flowchart of a representative process 200 for alarm monitoring. Process 200 specifically describes handling a situation in which a sensor that is on a time delay, such as the front door sensor 115, has been tripped. While process 200 will be discussed with the example of the front door sensor 115 being on a time delay, other alarms applications and installations will incorporate other sensors that utilize an alarm delay. That is, the front-door-open signal is one example embodiment of a security-zone-open signal. Accordingly, process 200 is equally applicable to any sensor or security zone that has an associated time delay. When the homeowner or other legitimate user opens the front door of the home 105 with the alarm system 100 armed, the alarm system 100 delays raising an alarm for a period of time of about 30 to 120 seconds. This delay provides time for the homeowner to enter a disarming code into the alarm panel 110, effectively notifying the alarm system 100 that the opening of the front door does not represent a threat. If the alarm system 100 does not receive the disarming code within the designated time, then the alarm system 100 will deem the front door opening as an intrusion and raise an alarm. As will be further discussed below with reference to FIG. 3, process 200 includes a sub-process for detecting tampering that could interfere with the alarm system's intended procedure for handling time delay sensors 115.

At step 205 of process 200, the homeowner arms the alarm panel 110, for example as the homeowner exits the home 105 on the way to work in the morning.

At step 210 of process 200, the alarm panel 110 notifies the server 120 that the alarm system 100 is armed. Accordingly, the server 120 monitors for any alarm data transmissions originating at the home 105.

At step 215, someone opens the front door and triggers the front door sensor 115. The person opening the front door might be the legitimate homeowner or an intruder.

At step 220, the front door sensor 115 transmits to the alarm panel 110 a front-door-open signal or other security-zone-open signal.

At step 225, the alarm panel 110 receives the front-door-open signal and forwards the signal to the server 225.

At step 230, in response to receipt of the front-door-open signal, the alarm panel 110 starts expecting entry of the disarming code within the specified delay, which is typically in a range of about 30 to about 120 seconds, as discussed above. Thus, receipt of the front-door-open signal starts an alarm panel timer.

Figure 3:
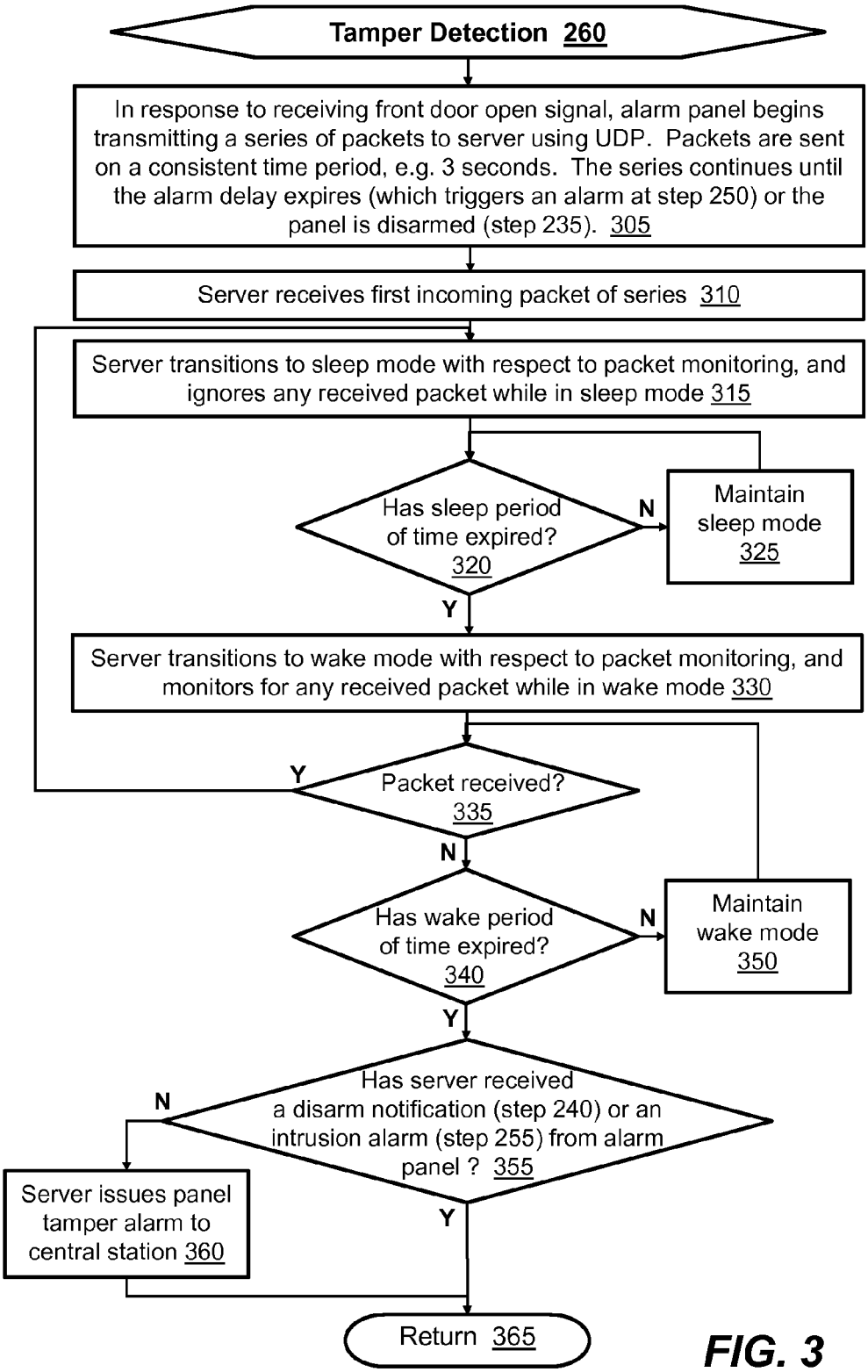
FIG. 3 is a flowchart of a process for detecting alarm system tampering according to certain embodiments.

Receipt of the front-door-open signal at the alarm panel 100 further initiates a tamper detection process at step 260 that FIG. 3 illustrates in flowchart, as discussed below. The tamper detection process of step 260 can run in parallel with other steps of process 200 to facilitate detection of any tampering that may occur during a time delay.

At inquiry step 235, the alarm panel 110 checks for user entry of the disarming code. If the alarm panel 110 has received the disarming code, then process 200 branches to step 240.

At step 240, the alarm panel 110 notifies the server 120 that the alarm system 100 has been disarmed and thus that all is clear. Process 200 then ends.

If the alarm panel 110 has not received the disarming code at inquiry step 235, then process 200 executes inquiry step 245 rather than step 240.

At inquiry step 245, the alarm panel 110 determines whether the time delay has elapsed. In other words, the alarm panel 110 determines whether the timer started at step 230 has reached the time delay and thus expired. If the timer is still timing towards the delay, then execution of process 200 loops back to step 235. Steps 235 and 245 iterate until the alarm panel 110 is disarmed or the time delay expires.

If the time delay expires before the alarm panel 110 is disarmed, then process 200 executes step 250 from inquiry step 245.

At step 250, the alarm panel 110 deems the opening of the front door as an intrusion and raises an alarm. The alarm panel 110 transmits the intrusion alarm to the server 120.

At step 255, the server 120 receives the intrusion alarm from the alarm panel 110 and forwards the alarm to the central station 125. The central station 125 can act on the alarm by dispatching emergency personnel, opening a bidirectional voice channel to the alarm panel 110, or taking other action as deemed appropriate. Process 200 ends from step 255.

FIG. 3 illustrates a representative flowchart of a process for detecting alarm system tampering, as implemented at step 260 as a sub-process of process 200.

At step 305 of sub-process 260, the alarm panel 110 has received the front-door-open signal (or other security-zone-open signal that may have an associated time delay). In response to that signal receipt, the alarm panel begins transmitting a series of packets to a communication interface of the server 120 using user datagram protocol (UDP) or other high-speed, one-way (i.e. unidirectional) communication schema that has low overhead for efficiency. Thus, the server 120 comprises a communication interface configured for the unidirectional communication. Accordingly, the communication layer operates without needing to transmit a packet-receipt acknowledgement back to the alarm panel 110. The alarm panel 110 typically transmits the packets on a uniform time period, for example one packet every three seconds. Thus, the alarm panel 110 typically intends consistent time intervals between packet transmissions.

The alarm panel 110 continues the series of packet transmissions until the alarm delay expires or the alarm panel 110 receives a proper disarming code. As discussed above with reference to FIG. 2, with expiration of the time delay, process 200 branches from step 245 to step 250, and the alarm panel 110 raises an intrusion alarm. And when the alarm panel 110 receives the disarming code, process 200 branches from step 235 to step 240, and the alarm panel 110 notifies the server 120 that the alarm system 100 has been disarmed.

At step 310 of sub-process 260, the server 120 receives the first incoming packet in the series transmitted by the alarm panel 110. The first packet received by the server 120 is often the first packet sent by the alarm panel 110. However, the order of packet receipt may differ from the order of packet transmission, for example due to packet switching that occurs in the network, between transmission and receipt. In other words, the individual packets in the series may transmit over different network routes and thus experience different propagation delays.

At step 315 of sub-process 260, the server 120 transitions to a sleep mode with respect to detecting the incoming packets transmitted by the alarm panel 110 at step 305. This sleep mode continues for a specified period of time, for example 25 seconds. Thus, the server 120 responds to receipt of the first incoming packet by ignoring any packets that may arrive during a time period of 25 seconds. Ignoring packets frees the computing/processing resources of the server 120 to perform other tasks that may include servicing a larger number of other alarm systems at other premises.

As an alternative to sleeping for a predetermined amount of time, the server 110 may utilize a sleep time that is random. The processor 170 may utilize a random number generator to provide sleep times that vary randomly within a range, for example a random amount of time that is between 20 and 30 seconds.

Inquiry step 320 of sub-process 260 determines whether the sleep time period has expired. If the sleep time period has not expired, then the sleep mode is maintained at step 325 and step 320 repeats. Accordingly, sub-process 260 iterates steps 320 and 325 until the sleep time period is complete. When the sleep time period is over, step 330 executes from step 320.

At step 330 of sub-process 260, the server 120 wakes up with respect to monitoring for packets from the alarm panel 110. The server 120 stays awake for a predetermined period of time, for example between 10 and 20 seconds, and monitors for a packet arrival during that time. As discussed below with reference to steps 335 and 340, the first packet arrival during that wake time causes the server 120 to revert to the sleep mode.

As an alternative to waking for a predetermined amount of time, the server 110 may utilize a time period that is random. The processor 170 may utilize a random number generator to provide wake times that vary randomly within a range, for example a random amount of time that is between 10 and 20 seconds.

At inquiry step 335, sub-process 260 branches according to whether the server 120 has received a packet from the alarm panel 110. If the server 120 has received a packet, then sub-process 260 loops back to step 315. If the server 120 has not received a packet, then inquiry step 340 executes.

If the wake period has not expired, then step 350 executes, the wake mode continues, and steps 335, 340, and 350 iterate until the wake period expires without receipt of a packet.

When the wake period expires without receipt of a packet, then inquiry step 355 executes from step 340. Step 355 inquires as to whether the sever 120 has received a disarm notification or an intrusion alarm per steps 240 and 255 respectively of process 200. If the inquiry is negative, then the server 120 determines that an intruder or other person has tampered with the alarm system 100 and issues a panel tamper alarm for transmission to the central monitoring station 125 via a communication interface. The central monitoring station 125 may open a voice channel to the alarm system 100, dispatch police, or take other action as appropriate.

If execution of step 335 results in a determination that an intrusion alarm has been triggered or that the alarm panel 110 has been properly disarmed, then at step 365, the sub-process 260 returns to process 200 as discussed above. Return similarly occurs following execution of step 360. In both cases, the alarm panel 110 ceases transmitting the series of packets.

Technology for tamper detection has been described. From the description, it will be appreciated that embodiments of the present technology overcome limitations of the prior art. Those skilled in the art will appreciate that the present technology is not limited to any specifically discussed application or implementation and that the embodiments described herein are illustrative and not restrictive. From the description of the exemplary embodiments, equivalents of the elements shown therein will suggest themselves to those skilled in the art, and ways of constructing other embodiments of the present technology will appear to practitioners of the art.

What is claimed is:

1. A server comprising:

a first communication interface that is configured to receive communications transmitted from an alarm panel, wherein the alarm panel is configured to transmit an arming notification, a disarm notification, an intrusion alarm, and packets transmitted periodically in a unidirectional communication protocol when a sensor connected to the alarm panel is triggered, wherein the alarm panel is further operable to stop transmitting packets in the unidirectional communication protocol when an alarm delay of the alarm panel expires or when the alarm panel is disarmed;

a second communication interface that is configured for bidirectional communication with a central monitoring station;

a processor that comprises:

a first connection to the first communication interface;

a second connection to the second communication interface;

memory; and processor executable instructions stored in the memory to perform the steps of:

monitoring for the arming notification transmitted from the alarm panel;

monitoring for the disarm notification transmitted from the alarm panel;

monitoring for the intrusion alarm transmitted from the alarm panel;

responsive to receipt of the intrusion alarm, notifying the central monitoring station of the intrusion alarm;

alternating between:

for a first period of time, monitoring the first communication interface for a packet of the packets transmitted periodically in the unidirectional communication protocol from the alarm panel when the sensor connected to the alarm panel is triggered; and for a second period of time, ignoring the packets transmitted periodically in the unidirectional communication protocol from the alarm panel when the sensor connected to the alarm panel is triggered, wherein detection of the monitored-for packet of the packets transmitted periodically in the unidirectional communication protocol from the alarm panel during the first period of time suspends the packet monitoring of the first period of time and initiates the second period of time, and wherein completion of the second period of time without detecting the monitored-for disarm notification and without detecting the monitored-for intrusion alarm initiates a subsequent execution of the first period of time; and responsive to a completion of the subsequent execution of the first period of time during which the monitored-for packet has not been detected, the monitored-for disarm notification has not been received, and the monitored-for intrusion alarm has not been received, notifying the central monitoring station of an occurrence of a tampering event.

2. The server of claim 1, wherein the first period of time is predefined.

3. The server of claim 1, wherein the first period of time comprises randomness within a range.

4. The server of claim 1, wherein the second period of time is predefined.

5. The server of claim 1, wherein the second period of time comprises randomness within a range.

6. The server of claim 1, wherein the packets transmitted periodically are periodic with a period, and wherein the first period of time is greater than twice the period.

7. he server of claim 1, wherein the packets transmitted periodically are periodic with a period, and wherein the second period of time is greater than twice the period.

8. The server of claim 1, wherein second period of time is greater than twice the first period of time.

9. The server of claim 1, wherein the unidirectional protocol is user datagram protocol (UDP).

10. A method for detecting tampering of an alarm system, comprising the steps of:

monitoring for an arming notification transmitted from an alarm panel of the alarm system;

monitoring for a disarm notification transmitted from the alarm panel;

monitoring for an intrusion alarm transmitted from the alarm panel;

monitoring for packets transmitted periodically in a unidirectional communication protocol when a sensor connected to the alarm panel is triggered, wherein the alarm panel stops transmitting packets in the unidirectional communication protocol when an alarm delay of the alarm panel expires or when the alarm panel is disarmed;

responsive to receipt of the intrusion alarm, notifying a central monitoring station of the intrusion alarm;

alternating between:

for a first period of time, monitoring for a packet of the packets transmitted periodically in the unidirectional communication protocol from the alarm panel when the sensor connected to the alarm panel is triggered; and for a second period of time, ignoring the packets transmitted periodically in the unidirectional communication protocol from the alarm panel when the sensor connected to the alarm panel is triggered, wherein detection of the monitored-for packet of the packets transmitted periodically in the unidirectional communication protocol from the alarm panel during the first period of time suspends the packet monitoring of the first period of time and initiates the second period of time, and wherein completion of the second period of time without detecting the monitored-for disarm notification during the second period of time and without detecting the monitored-for intrusion alarm during the second period of time initiates a subsequent execution of the first period of time; and responsive to completion of the subsequent execution of the first period of time during which the monitored-for packet has not been detected, the monitored-for disarm notification has not been received, and the monitored-for intrusion alarm has not been received, notifying the central monitoring station of an occurrence of a tampering event.

11. The method of claim 10, wherein the first period of time is predefined.

12. The method of claim 10, wherein the first period of time comprises randomness within a range.

13. The method of claim 10, wherein the second period of time is predefined.

14. The method of claim 10, wherein the second period of time comprises randomness within a range.

15. The server of claim 10, wherein the packets transmitted periodically are periodic with a period, and wherein the first period of time is greater than twice the period.

16. The server of claim 10, wherein the packets transmitted periodically are periodic with a period, and wherein the second period of time is greater than twice the period.

17. The method of claim 10, wherein second period of time is greater than twice the first period of time.

18. The method of claim 10, wherein the unidirectional protocol is user datagram protocol (UDP).

19. A system comprising:

an alarm panel configured to perform the steps of:

transmitting an arming notification to a server in response to user entry of an arming command;

transmitting a disarming notification to the server in response to user entry of a disarm notification;

responsive to receiving a signal from a sensor while the alarm panel is armed, transmitting an intrusion alarm to the server if the alarm panel is not disarmed within a first period of time following receipt of the signal; and responsive to receiving the signal from the sensor while the alarm panel is armed, transmitting a series of packets to the server using a unidirectional protocol; and the server configured to perform the steps of:

responsive to receiving a packet in the series, ignoring any packets in the series incoming during a second period of time;

responsive to conclusion of the second period of time, monitoring for another packet in the series incoming during a third period of time;

if the another packet in the series is received during the third period of time, then ignoring any packets in the series incoming during a fourth period of time; and if the another packet in the series is not received during the third period of time, then raising a tampering alarm unless the disarming notification is received during the third period of time and unless an intrusion alarm is received during the third period of time.

20. The system of claim 19, wherein the unidirectional protocol is UDP.

* * * * *